US005536071A

United States Patent [19]

Kraftick

[11] Patent Number: 5,536,071

[45] Date of Patent: Jul. 16, 1996

[54] FOOTREST FOR RELIEVING BACK FATIGUE AND PAIN

[76] Inventor: Karen A. Kraftick, 151 C Calle Ojo Feliz, Santa Fe, N.M. 87505

[21] Appl. No.: 114,693

[22] Filed: Aug. 30, 1993

Related U.S. Application Data

[63] Continuation-in-part of Ser. No. 873,743, Apr. 24, 1992, abandoned.

[51] Int. Cl.[6] ..... A47C 16/00

[52] U.S. Cl. ..... 297/423.41; D6/491

[58] Field of Search ..... 297/423.14; 248/918, 248/118.5, 118.1, 118, 118.3, 345.1; 5/652, 481; D6/491, 595, 596, 597, 601, 349, 351; 49/467; D99/29

[56] References Cited

U.S. PATENT DOCUMENTS

| | | | |
|---|---|---|---|
| D. 47,140 | 3/1915 | Newkirk | D6/601 |
| D. 314,879 | 2/1991 | Painter | D6/601 |
| D. 320,715 | 10/1991 | Magnin et al. | D6/601 |
| D. 345,468 | 3/1994 | McVicker | D6/349 |
| 740,071 | 8/1903 | Allen | 297/423.41 |
| 2,748,838 | 6/1956 | Scholl | 297/423.41 |
| 3,360,887 | 1/1968 | Parks et al. | 49/467 |
| 3,566,541 | 3/1971 | Coulter | 49/467 |
| 4,076,876 | 2/1978 | Bowles | 297/423.41 |
| 4,539,977 | 9/1985 | Schneider, Sr. | 297/423.41 |
| 4,807,392 | 2/1989 | Kirk | 49/467 |
| 5,158,255 | 10/1992 | Fuller | 248/118 |

FOREIGN PATENT DOCUMENTS

| | | | |
|---|---|---|---|
| 556953 | 9/1923 | France | 5/481 |
| 328366 | 4/1958 | Switzerland | 297/423.41 |
| 1111784 | 5/1968 | United Kingdom | 49/467 |
| 2063341 | 6/1981 | United Kingdom | 49/467 |
| 2201589 | 9/1988 | United Kingdom | 5/481 |

*Primary Examiner*—Louis J. Casaregola
*Assistant Examiner*—Roland G. McAndrews, Jr.
*Attorney, Agent, or Firm*—Samuel M. Freund

[57] ABSTRACT

A footrest for relieving back pain and fatigue. The subject footrest has a generally convex surface which permits a sitting or standing user thereof to safely and stably place a foot thereon in a multiplicity of positions. Various heights thereof may be employed to achieve the desired result. Construction using compressible materials at the location of contact between the foot and footrest enhances user comfort.

2 Claims, 3 Drawing Sheets

FOOTREST FOR RELIEVING BACK FATIGUE AND PAIN

This is a continuation-in-part of application Ser. No. 07/873,743 filed on Apr. 24, 1992 now abandoned.

BACKGROUND OF THE INVENTION

The present invention relates generally to footrests, and more particularly to a footrest adapted to stably raise the user's foot in a multiplicity of positions in order to relieve back fatigue and pain.

It is well-known that lumbar hyperlordosis (increased curve of the lower back) and an increased sacral angle are major contributors to low back fatigue, stress and pain; and that by decreasing the lordosis and sacral angle, such back problems can often be reduced or eliminated. See, for example, *Low Back Pain: Medical Diagnosis and Comprehensive Management*, by David G. Borenstein and Sam W. Wiesel, W. B. Saunders Company (Philadelphia, 1989), *Low Back Pain Syndrome* by Rene Cailliet, F. A. Davis Company (Philadelphia, 1988), "Epidemiology and the Impact of Low-Back Pain," by J. L. Kelsey and A. A. White, SPINE (1980), "Lumbosacral Junction: Roengenographic Comparison of Patients With and Without Backaches," by Clarence A. Splithoff, J. Am. Med. Assoc. (Aug. 22, 1953), "The Effect Of Posture on The Role of The Apophysial Joints In Resisting Intervertebral Compressive Forces," by M. A. Adams and W. C. Hutton, J. Bone and Joint Surg., August, 1980, *Understand Your Backache*, by R. Cailliet, p. 56(1984), and *Low Back Pain: Mechanism, Diagnosis, And Treatment*, by James M. Cox, Fifth Ed. (Williams & Wilkins, 1990). In fact, doctors have instructed symptomatic patients, who spend significant time standing, to stand with one foot on a stool, a brick, or a block of wood. However, these items permit only a single foot position leading to poor balance and patient discomfort and eventual disuse.

Many cushion-like devices have been used for a variety of purposes. See, for example, "Bolster And Sham Holder," by F. Newkirk, Design U.S. Pat. No. 47,140, which issued on Mar. 23, 1915, and "Seat Cusion For Use In A Bathtub 0r The Like," by Maurice Y. Magnin and Mary J. Reid, Design U.S. Pat. No. 320,715, which issued on Oct. 15, 1991. Such devices have a generally low profile and are constructed of materials too soft to stably support the weight of a standing individual.

Accordingly, it is an object of the present invention to provide an apparatus for stably and comfortably raising one foot of a sitting or standing individual in order to decrease lumbar lordosis and decrease the sacral angle.

Another object of the present invention is to provide an apparatus for stably raising one foot of a sitting or standing individual in order to decrease lumbar lordosis and decrease the sacral angle, while permitting the foot to assume a multiplicity of positions in order to increase the user's comfort.

Yet another object of my invention is to provide an apparatus for relaxing one foot at a time of a standing individual.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the footrest of this invention includes a base portion for stably locating the footrest on a ground surface, and a substantially rigid, body portion attached to or integral with the base and adapted to receive and raise one foot of a user in a multiplicity of positions.

It is preferred that the base portion be substantially planar and rectangular, and that the body portion has a generally cylindrical shape.

Preferably also, both the base portion and the body are covered with a non-slip material.

It is also preferred that the non-slip material covering the body is compressible for user comfort.

In another aspect of the present invention in accordance with its objects and purposes, the footrest hereof may also include a base portion which is substantially planar and forms an annular region for stably locating the footrest on a ground surface surrounding a work location of the user thereof, and a substantially rigid, body portion attache d to or integral with the base, coextensive therewith, and adapted to receive and raise one foot of the user in a multiplicity of positions.

Benefits and advantages of the invention include user comfort, safety, and stability, while providing relief from back and foot fatigue and pain.

BRIEF DESCRIPTION OF THE DRAWINGS

The accompanying drawing, which is incorporated in and forms a part of the specification, illustrates one embodiment of the present invention and, together with the description, serves to explain the principles of the invention.

DETAILED DESCRIPTION OF A PREFERRED EMBODIMENT OF THE INVENTION

Briefly, the present invention includes a footrest having a base for locating the footrest on a ground surface, and a body, either attached to or integral with the base, for permitting the foot of a user to be stably and comfortably raised and located in a multiplicity of positions at a chosen height from the ground surface.

Figure 1:
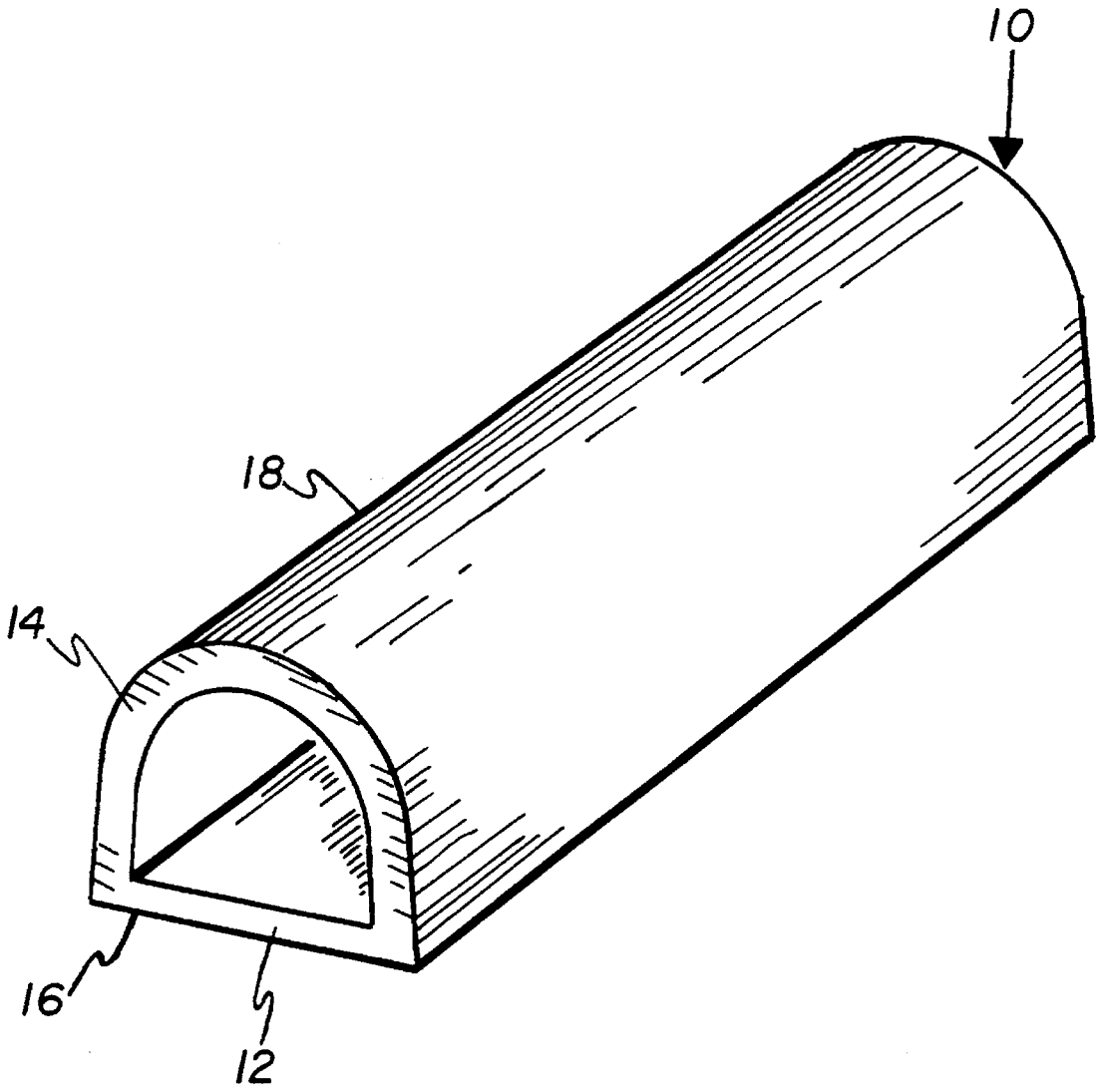
FIG. 1 is a schematic representation of one embodiment of the footrest of the present invention illustrating the situation where the base and a hollow body are integrally formed.

Reference w ill now be made in detail to the present preferred embodiments of the invention, examples of which are illustrated in the accompanying drawings. Turning now to the drawings, FIG. 1 shows a schematic representation of the apparat of the present invention. Footrest 10 includes a base 12 and a body 14, shown here integrally attached. I t i s anticipated that an overall height for the footrest of between three and seven inches, with a preferred height of between four and five inches, would provide relief for most users. However different detachable bases, each having a chosen thickness, might be employed to enable the overall height to be varied. In such situations, body 14 would be reversibly removable from base 12. Alternatively, additional bases might be stacked together in order to achieve the desired height. An approximately six inch length is anticipated to provide sufficient stability for the footrest. Shown in FIG. 1 is a hollow cylindrical-shaped body 12, which provides sufficient strength at low-cost and weight when constructed from hard rubber. Clearly, other construction materials can be employed and other generally convex shapes might be envisioned to suit particular purposes and situations. In a preferred embodiment of the invention, the outer surfaces 16 and 18, respectively, of both base 12 and body 14 could be covered with non-slip material to improve safety. The non-slip material used to cover body 14 could be compressible to improve user comfort. A variable-shape sandbag might also be affixed to base surface 16 in order that base 12, shown to be rectangular and planar in FIG. 1, could be used in situations where the ground surface was uneven.

Figure 2B:
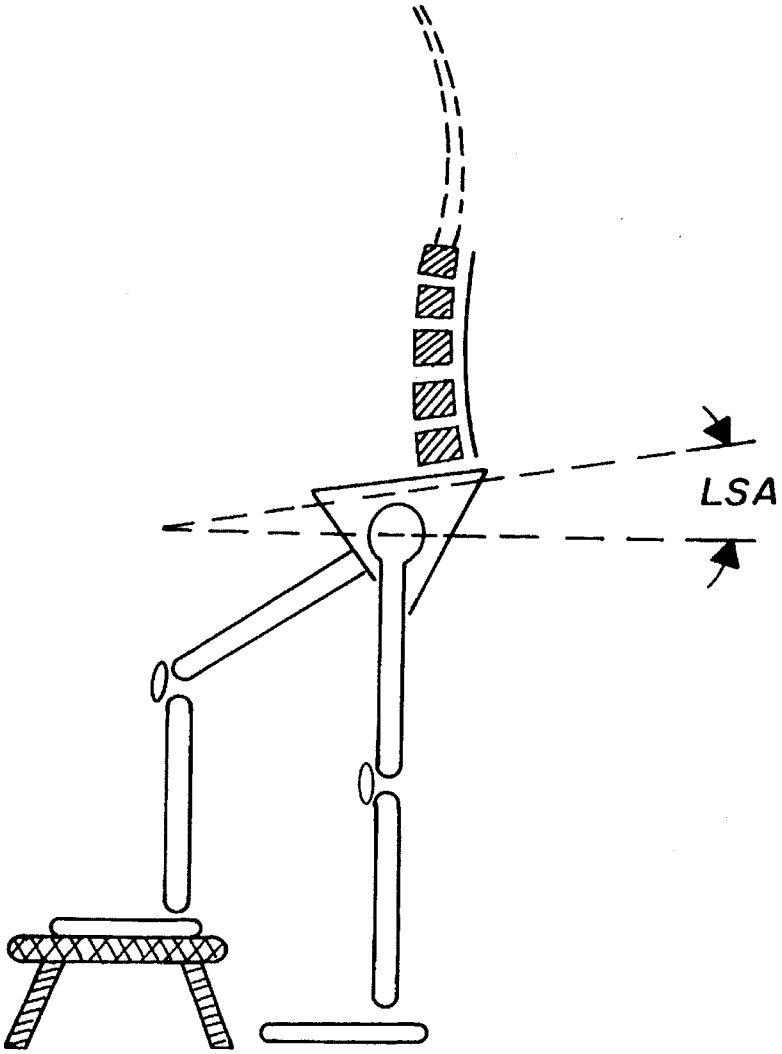
FIGS. 2*a* and 2*b* illustrate the reduction in sacral angle and lumbar lordosis when one foot is raised, as shown in FIG. 2*b*, for a standing individual.
Figure 2A:
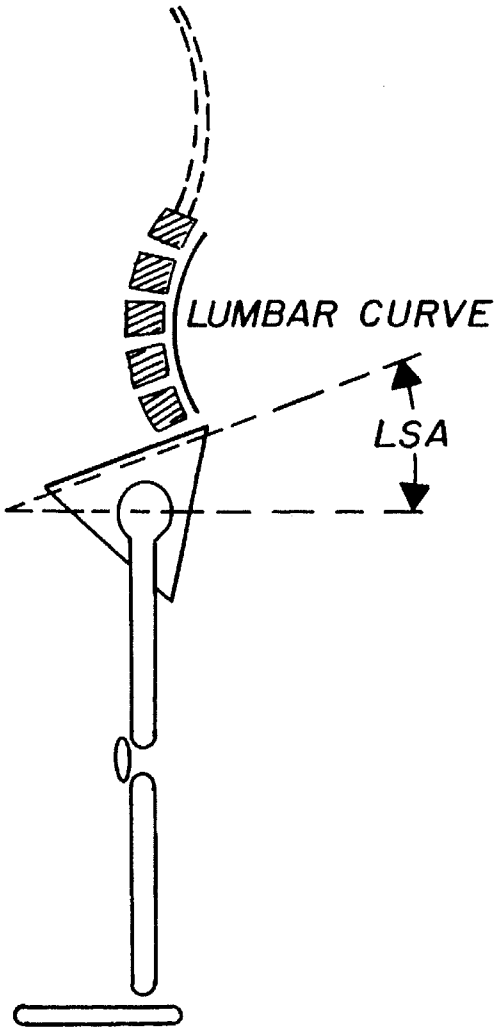

FIGS. 2*a* and 2*b* illustrate the reduction in sacral hngle and lumbar lordosis when one foot is raised, as shown in FIG. 2*b*, for a standing individual.

Figure 3A:
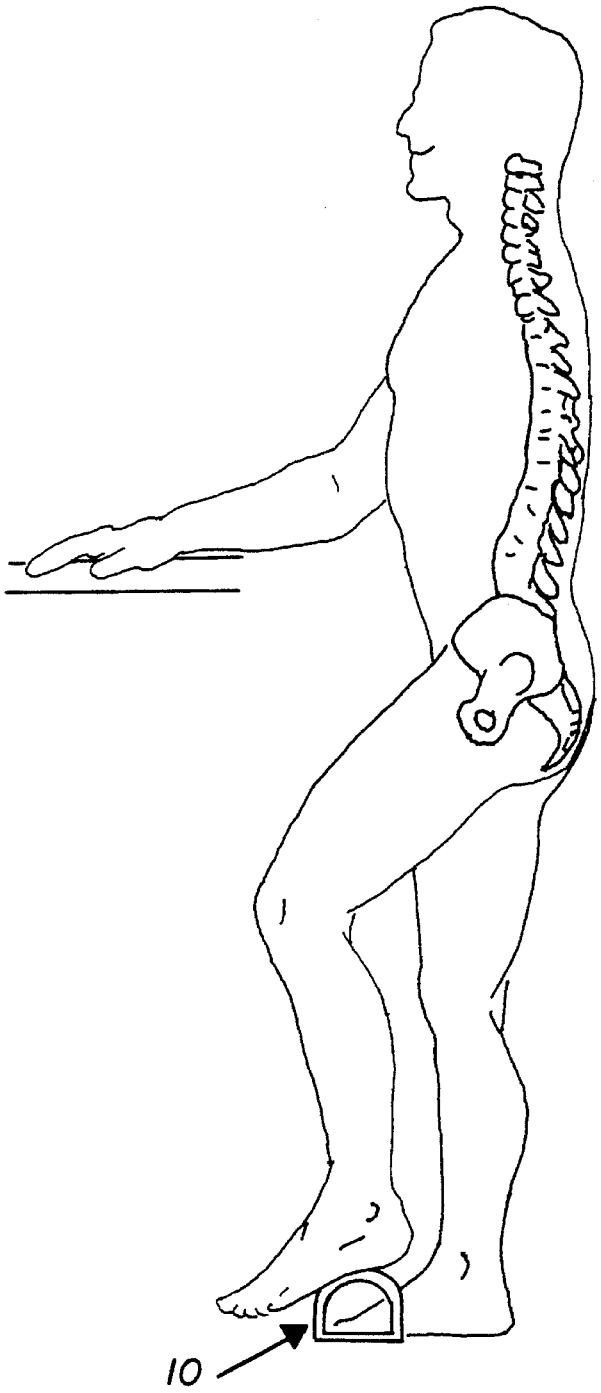
FIGS. 3*a* and 3*b* illustrate the use of the apparatus of the present invention to raise the foot of a user, FIG. 3*a* showing, in particular, that the foot may be positioned in other than the horizontal orientation.
Figure 3B:
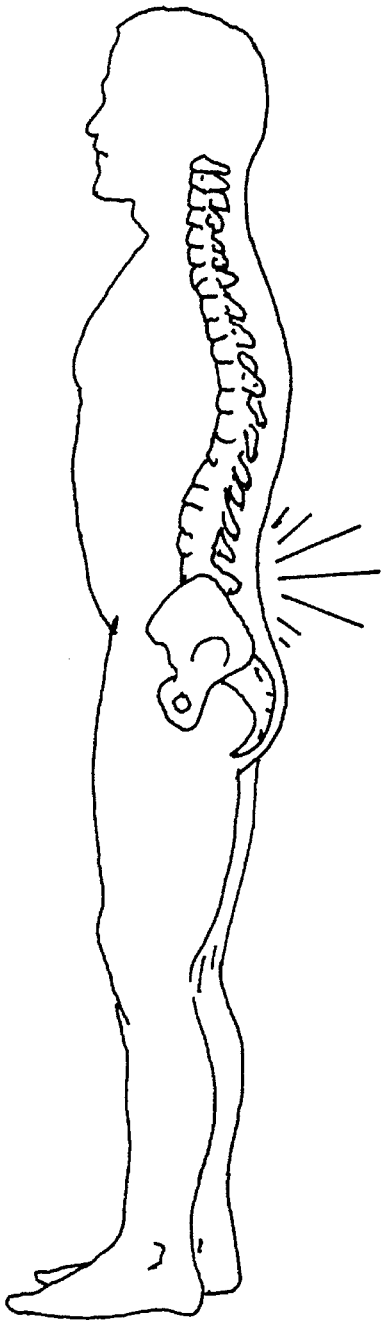

FIGS. 3*a* and 3*b* illustrate the use of the apparatus of the present invention to raise the foot of a user, FIG. 3*a* showing, in particular, that the foot may be positioned in other than the horizontal orientation. FIG. 3*b* shows schematically, by contrast, the increase in the curvature of the spine when the apparatus of the present invention is not employed by a standing individual.

In situations such as beauty parlors, barbershops and the like, the base of the present invention might be extended into an annular or partially annular configuration for placement around a swivel chair, for example. The body portion would likewise be extended to be coextensive with the base. In this manner, the user would be able to raise his or her foot and achieve the benefits of the present in any invention location around the center of work. For the full annular footrest embodiment, it is contemplated that the both the base and the body might have removable portions in order that the footrest might be readily positioned around the center of work.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, it would be apparent to one having ordinary skill in the art that if a variable height footrest was desirable, adjustable legs could be attached to the base of the footrest. Additionally, self-leveling legs might be employed. The embodiment was chosen and described in order to best explain the principles of the invention and its practical application to thereby, enable others skilled in the art to best utilize the invention in various embodiments and with various modifications as are suited to the particular use contemplated. It is intended that the scope of the invention be defined by the claims appended hereto.

What I claim is:

1. A footrest for relieving back fatigue and pain, comprising in combination:

a. a base portion for stably locating said footrest on a ground surface; and b. a rigid, body means rigidly supported by said base portion, said body means having a generally concave shape facing said base portion and a generally convex shape facing away from said base portion, and being adapted to receive the foot of a user of said footrest in a multiplicity of positions, wherein said body portion and said base portion together form a hollow portion.

2. The footrest as described in claim 1, wherein said base portion is substantially planar.

* * * * *